United States Patent [19]

Perotto

[11] 4,428,130

[45] Jan. 31, 1984

[54] INNER BOOT STRUCTURE PARTICULARLY FOR SKI BOOTS

[75] Inventor: Riccardo Perotto, Volpago Del Montello, Italy

[73] Assignee: Nordica S.p.A., Montebelluna, Italy

[21] Appl. No.: 378,446

[22] Filed: May 14, 1982

[30] Foreign Application Priority Data

May 19, 1981 [IT] Italy ..... 21814/81[U]

[51] Int. Cl.[3] ..... A43B 5/04; A43B 3/10

[52] U.S. Cl. ..... 36/117; 36/10

[58] Field of Search ..... 36/117, 10, 105

[56] References Cited

U.S. PATENT DOCUMENTS 4,182,056 1/1980 Dalebout ..... 36/117

4,268,931 5/1981 Salomon ..... 36/117

FOREIGN PATENT DOCUMENTS 569438 11/1975 Switzerland ..... 36/105

*Primary Examiner*—Patrick D. Lawson

*Attorney, Agent, or Firm*—Guido Modiano; Albert Josif

[57] ABSTRACT

The inner boot or removable liner, particularly for ski boots provided for being slipped on from their rear ends, comprises a body enclosing the skier's foot region and a leg portion extending therefrom. In the body a cutout is formed which extends longitudinally and is delimited by a pair of flaps arranged to overlap each other. Along the flaps a closure pull-out band is located effective to hold the inner boot in the closure position thereof.

4 Claims, 2 Drawing Figures

INNER BOOT STRUCTURE PARTICULARLY FOR SKI BOOTS

BACKGROUND OF THE INVENTION

This invention relates to an inner boot structure particularly for ski boots.

As is known, it is current practice to equip ski boots with inner boots or removable liners which have the function of making the boot fit more comfortable, while holding the skier's foot firmly within the ski boot.

A current trend is toward the production of ski boots which are entered from the rear end to facilitate the ski boot wearing procedure; this poses, however, some problems as regards the provision of a suitable inner boot or linear.

Presently available inner boots of foamed construction or not foamed construction, particularly for ski boots of the rear entrance type, are scarcely practical and comfortable, and in many cases their constructions are rather complex.

As a rule, prior inner boots for this type of ski boots may be broadly divided into two classes: those comprising a complete inner boot and those comprising a partial inner boot.

More specifically, the complete inner boot, which may be foamed in or not, is formed with two side cuts made along perpendicular sections to the ankle joint bones for fitting purposes.

This solution enables the rear portion to move sideways, and creates uncomfortable bulges of material mainly at the initial areas of the side cuts and is uncomfortable at the ankle joint bone regions.

The partial inner boot comprises a removable liner also foamed in or not, which only encircles the foot region, leaving the ankle and lower leg portion regions uncovered.

The areas left uncovered by the inner boot are protected and enclosed by paddings attached to the front and rear of the leg portions which constitute the ski boot.

As may be readily appreciated, the latter approach system is quite wasteful, since a number of different parts are to be manufactured to produce a complete inner boot, while various processing steps are required to sew the paddings along the edges of the ski boot leg portions.

SUMMARY OF THE INVENTION

Accordingly the task of this invention is to overcome such prior shortcomings by providing an inner boot or removable liner which can be obtained in a complete form and fits perfectly, particularly intended for ski boots which open at the rear.

Within this task it is an object of the invention to provide an inner boot which slips on easily, while ensuring an improved wrapping of the skier's foot and leg.

A further object of this invention is to provide an inner boot which, while being highly comfortable, can provide improved security for the skier's foot and lower leg portion.

Yet another object of this invention is to provide an inner boot as indicated, which can minimize all of the steps involved in its manufacture process.

According to one aspect of the present invention, the above task and objects as well as yet other objects, such as will be apparent hereinafter, are achieved by an inner boot structure particularly for ski boots, comprising a body enclosing the skier's foot region and a leg portion extending from said body, characterized in that it further comprises, formed in said leg portion, a cutout extending longitudinally and being delimited by a pair of flaps arranged to overlap each other.

BRIEF DESCRIPTION OF THE DRAWING

Further features and advantages will become more apparent from the following detailed description of an inner boot structure particularly for ski boots, with reference to the accompanying exemplary drawing, where.

DESCRIPTION OF THE PREFERRED EMBODIMENTS

Figure 1:
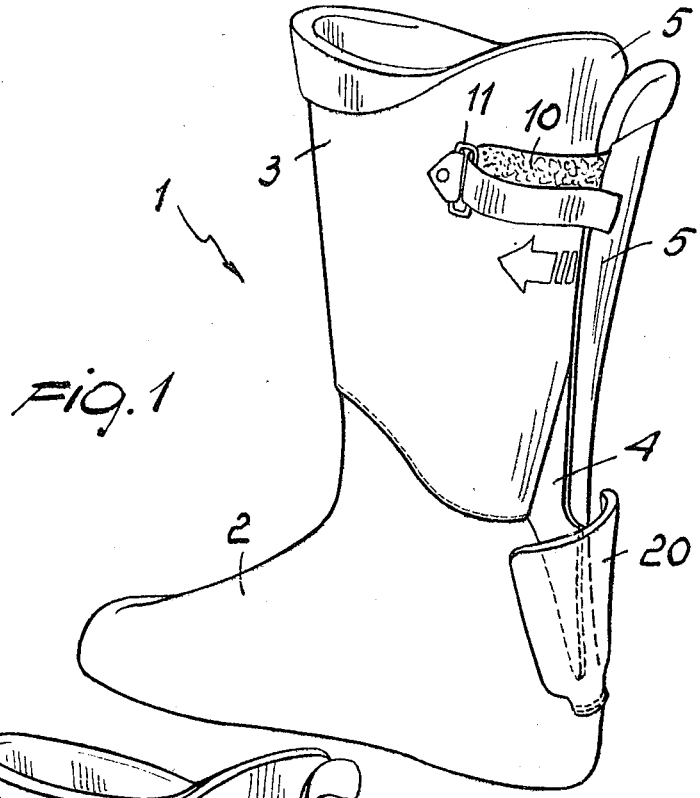
FIG. 1 is a rear perspective view of the subject inner boot or removable liner.
Figure 2:
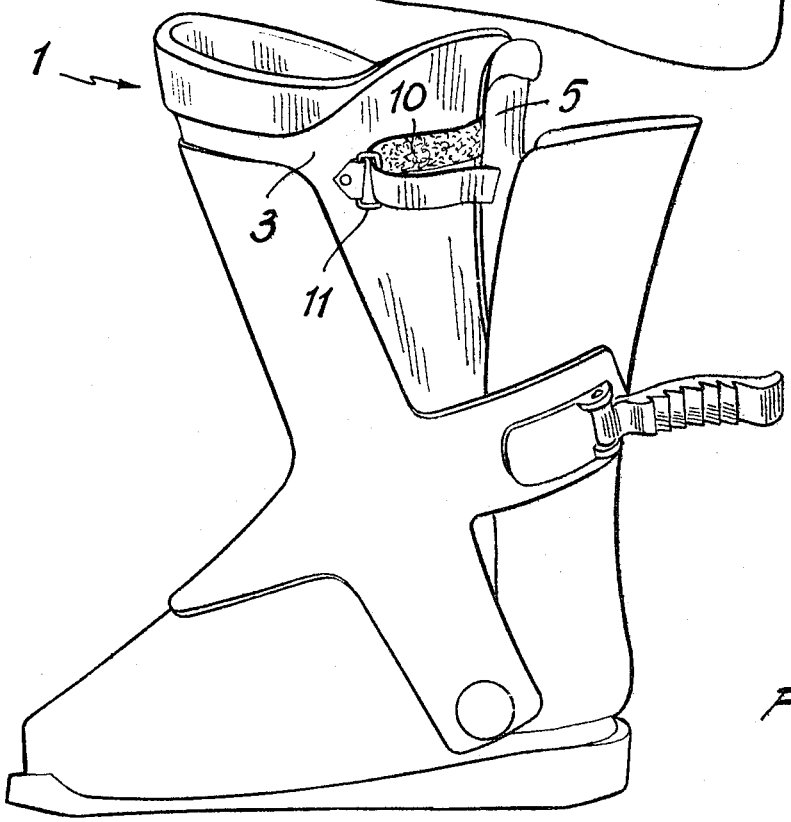
FIG. 2 is a perspective view of the inner boot as fitted to the inside of a ski boot.

With reference to the drawing figures, the inner boot for ski boots according to this invention, which is generally indicated at 1, comprises a body 2 enclosing the skier's foot region, and a leg portion 3 which extends from said body 2.

Advantageously, the body 2 and leg portion 3 are a single piece construction, and may be formed by a foaming in process or other suitable techniques.

A peculiar feature of the invention is that on the leg portion 3, a cutout 4 is provided which extends longitudinally and, as it is shown in the accompanying drawing, is positioned at the rear of the ski boot, although it may also be placed on one side thereof, depending on contingent requirements.

The cutout 4 is delimited by a pair of flaps 5 which are arranged adjacent to the cutout 4 to overlap each other while in use, to close the inner boot around the user's leg.

For this purpose, closure means are provided on the flaps 5 which advantageously comprise a pull-out band length 10, e.g. of the type known commercially under the trademark of Velcro, which is associated with one flap and is passed through a ring 11 provided at the opposite flap.

To improve the ankle security during the wearing step, there is provided a rear flap 20 attached to the inner boot 1 at the initial area of the cutout 4, which partly overlies the cutout itself.

The above-described inner boot is extremely simple to use. In fact, to fit the inner boot on, it will be sufficient to unlatch the closure means and slip the foot in as with a standard shoe. After fitting the inner boot on the foot, the inner boot is closed by overlapping the flaps 5 on each other and closing the inner boot by means of the pull-out band length 10.

It should be noted that by providing for the flaps of the inner boot to overlap each other, the possibility is afforded of preventing the material from bulging out and of having the inner boot perfectly adherent to the user's leg.

It will be appreciated from the foregoing that the invention achieves its objects, and in particular that the inner boot according to this invention affords optimum wrapping of the foot and leg, while improving the retention of both the foot and lower leg portion.

Moreover, this inner boot is provided in a completed form, and requires no subsequent padding steps on the inside of the ski boot.

In practicing the invention, the materials used, on condition that they are compatible with the specific intended application, as well as the dimensions and contingent shapes, may be any selected ones to suit individual requirements.

I claim:

1. An inner boot structure particularly for ski boots, comprising a body for enclosing a skier's foot region, a leg portion extending from said body, a cutout formed in said leg portion and extending longitudinally, a pair of flaps adjacent said cutout and arranged to overlap each other, and closure means for said inner boot located along said flaps.

2. An inner boot structure particularly for ski boots, according to claim 1, wherein said closure means comprise a length of pullout band connected with one end to one of said flaps and in adapted to engage in a ring-like member provided on the opposite flap.

3. An inner boot structure particularly for ski boots, according to claim 1 characterized wherein said body and said leg portion are a single piece construction.

4. An inner boot structure particularly for ski boots, according to claim 1 further comprising a rear flap associated with said body and at least partly overlying said cutout, said rear flap being effective to contribute to the security of said inner boot fitting around a skier's ankle.

* * * * *